US005778298A

United States Patent [19]

Enomoto et al.

[11] Patent Number: 5,778,298

[45] Date of Patent: Jul. 7, 1998

[54] TRANSFER DEVICE HAVING A COPY MEDIUM GUIDE

[75] Inventors: Yoshihiro Enomoto; Nobuo Hyakutake; Hitoshi Funato; Tetsuya Fujita; Nobuyoshi Komatsu, all of Ebina, Japan

[73] Assignee: Fuji Xerox Co., Ltd., Tokyo, Japan

[21] Appl. No.: 751,986

[22] Filed: Nov. 19, 1996

[30] Foreign Application Priority Data

Nov. 21, 1995 [JP] Japan ..... 7-303108

[51] Int. Cl.[6] ..... G03G 15/00; G03G 15/16

[52] U.S. Cl. ..... 399/388; 399/316

[58] Field of Search ..... 399/303, 304, 399/316, 388, 390

[56] References Cited

U.S. PATENT DOCUMENTS 4,396,273 8/1983 Matsuyama et al. ..... 399/316
5,594,539 1/1997 Murano et al. ..... 399/316
5,602,636 2/1997 Matsuzawa ..... 399/388

*Primary Examiner*—Arthur T. Grimley
*Assistant Examiner*—Sophia S. Chen
*Attorney, Agent, or Firm*—Oliff & Berridge, PLC

[57] ABSTRACT

A transfer device includes a photosensitive drum on the outer surface of which an image to be transferred is formed; a transfer drum arranged in parallel to the photosensitive drum and substantially in contact with the outer surface of the photosensitive drum, the transfer drum capable of adsorbing a sheet on its outer surface; and a sheet guide for guiding the sheet supplied toward the transfer drum to a transfer position between the photosensitive drum and the transfer drum. At an end of the sheet guide on the side of the transfer position, a hill-shaped guide is provided which flexes at a flexing point in a plane orthogonal to the rotary axis of each of both drums so as to be convex toward the photosensitive drum. The side of the hill-shaped guide from the flexing point toward, and closest to, the transfer position is inclined toward the photosensitive drum with respect to a tangent of the photosensitive drum passing the transfer position.

5 Claims, 4 Drawing Sheets

TRANSFER DEVICE HAVING A COPY MEDIUM GUIDE

BACKGROUND OF THE INVENTION

1. Field of the Invention

The present invention relates to a transfer device which rotates a pair of drums on each other to transfer an image from one drum to a sheet adsorbed on the other drum, like for example, a color multiple transfer device.

2. Description of the Related Art

A color multiple transfer device is known in which plural color toner images formed on the outer surface of a photosensitive drum are transferred in superposition on a sheet, with a transfer drum arranged oppositely to the outer surface of the photosensitive drum, while both drums are rotated on each other with a sheet adsorbed on the outer surface of the transfer drum. In such a transfer device, individually provided are a charger for shifting a toner image on the photosensitive drum toward the transfer drum and another charger for adsorbing a sheet onto the transfer drum. The former charger is arranged at a transfer position (position where the photosensitive drum and the transfer drum are nearest to each other) whereas the latter charger is arranged apart from the transfer position in a direction opposite to the rotating direction of the transfer drum.

It is useless to adopt two chargers for a single transfer drum because the components are superfluous. If a thick sheet of paper is used, since a warping property is given to the sheet before the sheet is adsorbed on the transfer drum, the charger dedicated to adsorption apart from the transfer position may not necessarily be required. For this reason, it was proposed to omit the charger dedicated to adsorption and perform the transfer of a toner image and sheet adsorption by the charger arranged at the transfer position. But this gave rise to the following problems.

Use of a single charger does not permit a sheet to be previously adsorbed and thereafter the toner image to be guided to the transfer position so that the adsorption and transfer are performed simultaneously at the transfer position. Thus, in the first color transfer, the sheet cannot shift into the transfer position in an established posture, thereby creating a slight gap between the sheet and the photosensitive drum as the case may be. In this case, the transfer is performed while the uppermost layer of a toner image with weak electrostatic application force for the photosensitive drum or the toner particles with a small amount of charging from a developer are scattered in the vicinity of the transfer position. Thus, an image with scattered toner particles, called a blur, will be transferred on the sheet.

Creation of the above slight gap is attributable to the fact that the sheet shifting speed by a regi-roll (roller for shifting out the sheet toward the transfer drum) is set to be higher by about 0.5% than that by the transfer drum. Specifically, where the posture of the sheet rushing onto the transfer position fluctuates, changes in the sheet shifting speed create pulling or pushing of the sheet between the transfer position and the regi-roll. Thus, the transportation path of the sheet vertically snakes against a face of the sheet. As a result, the outer surface of the transfer drum is pushed toward the center of rotation by the sheet to create the above slight gap. Accordingly, the blur will be created continuously until the rear end of the sheet comes off the regi-roll in the course of shifting the sheet. At the time of the transfer of the second and successive colors, the sheet has been entirely adsorbed onto the transfer drum so that the blur due to the above slight gap will not be created.

SUMMARY OF THE INVENTION

The present invention has been made in view of the above, and therefore an object of the invention is to provide a transfer device which can suppress fluctuation of a sheet rushing onto a transfer position to carry out transfer with high quality.

The present invention can achieve the above object by providing a transfer device comprising: a photosensitive drum on the outer surface of which an image to be transferred is formed; a transfer drum arranged in parallel to said photosensitive drum and substantially in contact with said outer surface of said photosensitive drum, said transfer drum capable of adsorbing a sheet on the outer surface; and a sheet guiding means for guiding said sheet supplied toward said transfer drum to a transfer position between said photosensitive drum and said transfer drum, wherein at an end of said sheet guiding means on the side of said transfer position, a hill-shaped guide is provided which flexes at a flexing point in a plane orthogonal to the rotary axis of each of both drums so as to be convex toward said photosensitive drum; and the side of the hill-shaped guide from the flexing point toward, and closest to, the transfer position is inclined toward the photosensitive drum with respect to a tangent of said photosensitive drum passing the transfer position.

In accordance with the above arrangement, the sheet can be caused to rush onto the transfer position in its optimum posture while being appropriately warped along the flex of hill-shaped guide. The reason why the sheet is warped is as follows. If the nature of the sheet supplied to the transfer device is always unchanged, when the sheet is guided straight to the transfer position its posture is stable. The sheets actually used, however, are not uniform because of wavelike deformation or different water contents. Therefore, if the sheet is forcibly warped to be stroked to a certain degree before it rushes onto the transfer position, the rushing posture of the sheet can be stabilized.

The above and other objects and features of the present invention will be more apparent from the following description taken in conjunction with the accompanying drawings.

DETAILED DESCRIPTION OF THE PREFERRED EMBODIMENTS

Now, a description will be given in more detail of embodiments of the present invention with reference to the accompanying drawings.

Figure 1:
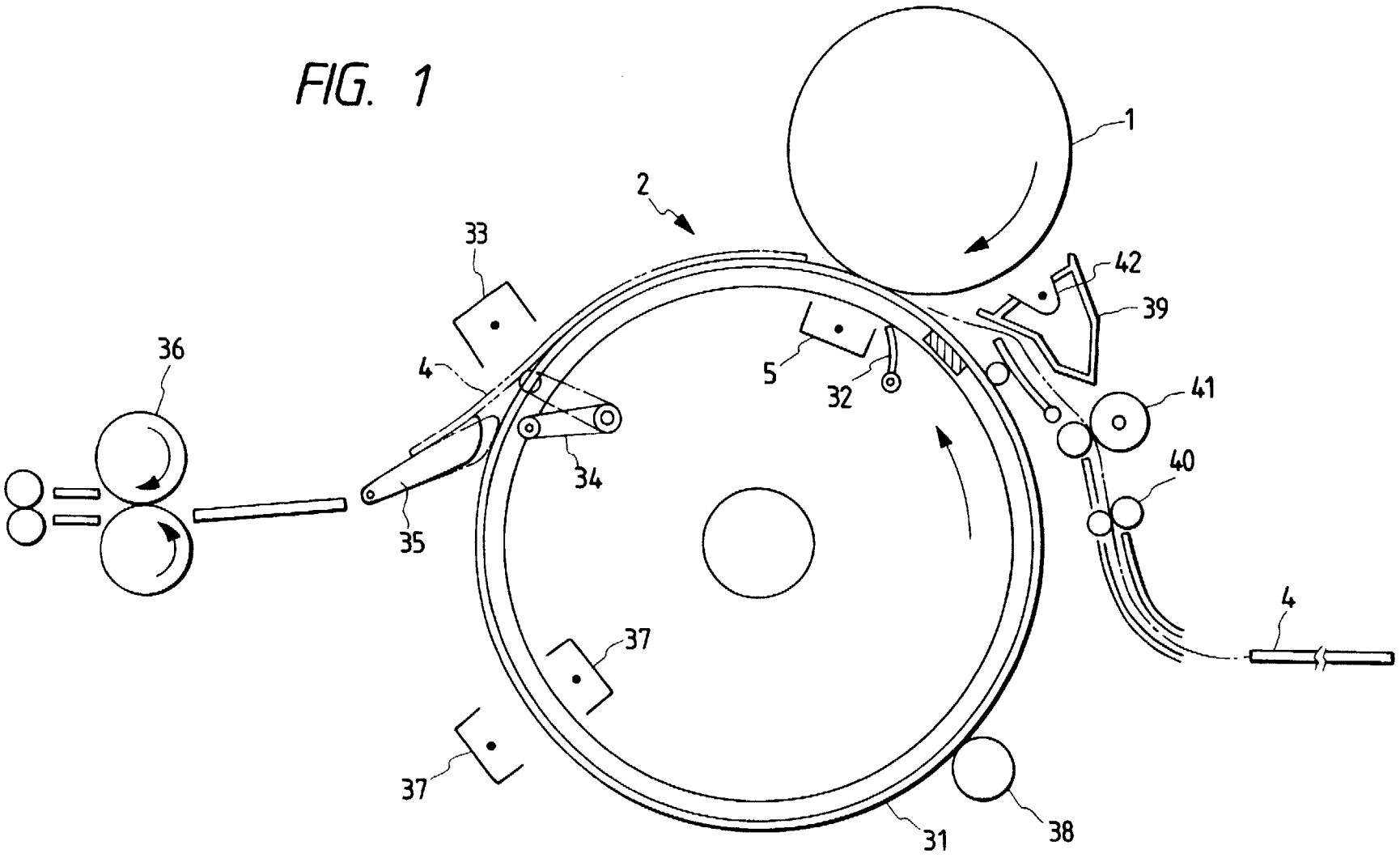
FIG. 1 is a view showing the main part of an image creating apparatus including a transfer device according to the present invention.

FIG. 1 is a view showing the main part of an image creating apparatus including a transfer device according to the present invention. The image creating apparatus is provided with a transfer drum 2 on which a drum sheet 31 is wound. In the vicinity of the transfer drum 2, the image creating apparatus has an adsorption/transfer corotron 5, a transfer baffle 32, discharging corotron 33, another discharging corotron 37, a cleaning brush 38, an internal pushing roll 34 and an exfoliating finger 35. The adsorption/transfer corotron is for adsorption-charging the drum sheet 31 to adsorb and hold a sheet thereon and also to transfer the toner image on a photosensitive drum 1 to the sheet 4. The transfer baffle 32 serves to push the drum sheet 31 from the inside so that the sheet 31 abuts the surface of the photosensitive drum 1 in a transfer step. The discharging corotron 33 serves to discharge the sheet 4 after the transfer step. The discharging corotron 37 serves to remove the charges on the drum sheet 31 for its cleaning after the transfer step. The cleaning brush 38 serves to clean paper powder or toner from the drum sheet 31 after the transfer step. In exfoliating the sheet 4, the internal pushing roll 34 serves to push the drum sheet 31 upward from the inside. The exfoliating finger 35 serves to exfoliate the sheet 4.

In FIG. 1, reference numeral 42 denotes a corotron before the transfer step; 39 a dust sucking duct; 36 a fixer for fixing the toner image on the sheet 4 after the transfer step; 40 a regi-roll for supplying the sheet 4 at predetermined timings; and 41 a roll-type curler for giving a curl promoting adsorption of the sheet 4 such as a thick sheet along the adsorption surface of the transfer drum 2.

The transfer device can be applied to an image creating apparatus of a type in which the toner image created on the photosensitive drum 1 by xerography or electrostatic recording is transferred to the sheet 4 while it is held on the transfer drum 2. In this embodiment, the transfer device is applied to a xerography-type color copier and operates as follows.

The transfer drum 2 rotates synchronously with the photosensitive drum 1 in which a xerography-type of image creation process unit (not shown) is arranged, and electrostatically adsorbs the sheet 4 on the drum sheet 31 by adsorption-charging by the corotron 5 for adsorption/transfer and pushing by the transfer baffle 32. The sheet 4 is supplied at predetermined times through the regi-roll 40 from the sheet supply tray, etc. (with the curl applied by the curler 41 as necessary). Simultaneously with the adsorption, a toner image, which is created on the photosensitive drum 1 by a xerographic image creating process, is electrostatically transferred to the sheet 4 adsorbed on the transfer drum 2 by the transfer-charging by the adsorption/transfer corotron 5. In the case of creating a full-color image, the transfer drum 2 is rotated with the sheet 4 held thereon so that it passes the position opposite to the photosensitive drum 1 the number of times of transfer thereby to transfer the second and subsequent color toner images successively created on the photosensitive drum 1 to the sheet 4 successively. Upon completion of the transfer of the final color toner image, the internal pushing roll 34 pushes up the drum sheet 31 and deforms it. At the same time, the exfoliating finger 35 abuts on the drum sheet 31. Thus, the sheet 4 after the transfer, while being discharged by the discharging corotron 33, is exfoliated from the drum sheet 31 under the action of the internal roll 34 and exfoliating finger 35. On the other hand, as for the transfer drum 2 after the sheet 4 has been exfoliated, the charges on the drum sheet 31 are removed by the corotron 37 for cleaning discharging, and thereafter paper powder applied to the drum sheet 31 is cleaned by the cleaning brush 38.

Embodiment 1

Figure 2:
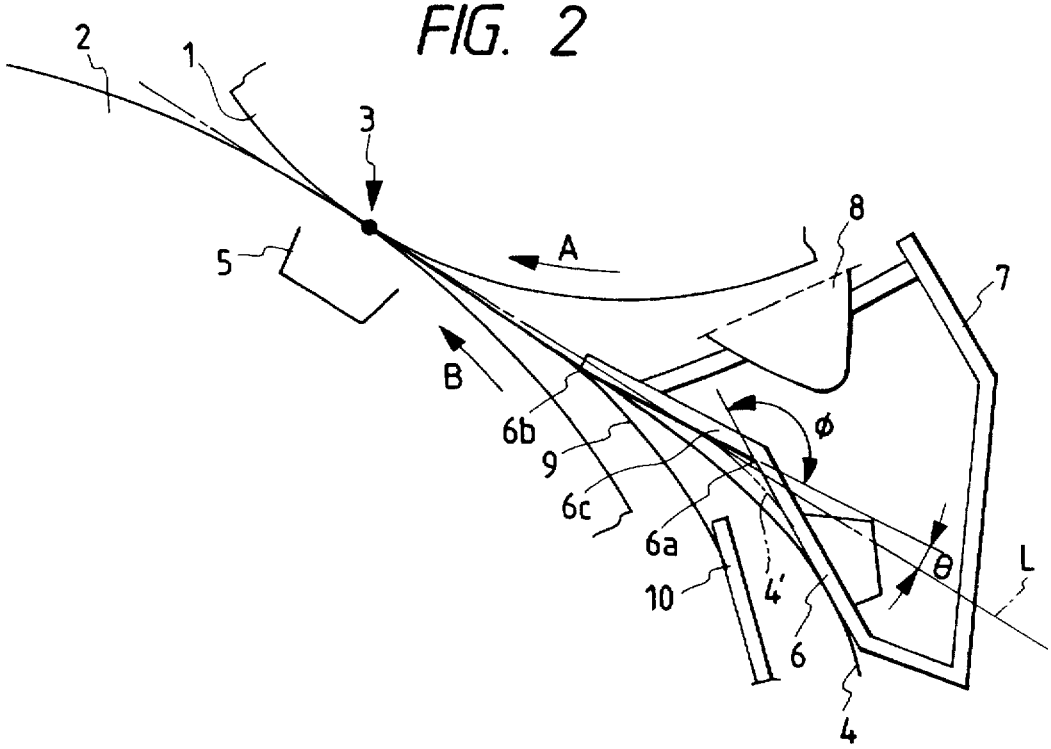
FIG. 2 is a view showing the main part of the transfer device according to the first embodiment of the present invention in a section orthogonal to the axis of each of a photosensitive drum and a transfer drum.

FIG. 2 shows a first embodiment of the present invention. In FIG. 2, the photosensitive drum 1 and the transfer drum 2 are rotated in the directions of arrows A and B with a center line of a rotary axis (not shown). With this rotation, toner images with plural colors (four colors of e.g. black, yellow, magenta, cyan, etc.) are successively created, for each of the colors, on the outer surface of the photosensitive drum 1. The sheet 4 is supplied to a transfer nip 3 between the drums 1 and 2 from right. Within the transfer drum 2, a charging corotron 5 is arranged so as to be aligned with the transfer nip 3. The charge generated by the charging corotron 5 adsorbs the sheet 4 onto the outer surface of the transfer drum 2. Further, the rotation of the drums 1 and 2 and charge of the charging corotron 5 transfer the toner images to the sheet 4 in successive superposition of the respective colors. Upon completion of transfer of all the color toner images, the sheet 4 is exfoliated from the transfer drum 2 and drawn out to the left side of the transfer nip 3.

On the right side of the transfer nip 3, a hill-shaped guide 6 for causing the sheet 4 to rush into the transfer nip 3 is arranged. The hill-shaped guide 6 is formed integrally to a dust sucking duct 7. The hill-shaped guide 6 and the dust sucking duct 7 may be fabricated by several kinds of methods. However, in order to guide the sheet 4 accurately, with a small structural error of the hill-shaped guide 6, a fabricating technique capable of giving high accuracy such as injection molding is preferable. Incidentally, numeral 8 denotes a transfer-assisting charging scorotron attached to the dust sucking duct 7. Arranged on the upstream side (lower right in the figure) of the hill-shaped guide 6 are a sheet guiding member other than the hill-shaped guide 6 and a regi-roll for supplying the sheet 4 toward the hill-shaped guide 6. These members are not shown.

The details of the hill-shaped guide 6 are as follows. First, the flexing point 6*a* of the hill-shaped guide 6 protrudes toward the photosensitive drum 1 from the tangent L of the photosensitive drum 1 drawn from the transfer nip 3, and the tip 6*b* of the hill-shaped guide 6 (corresponding to the end of the guide 6 nearest the transfer nip 3) is located at a lower position than the tangent L. The tip 6*b* may alternatively be located on the tangent L. The distance between the tip 6*b* and the transfer nip 3, which is determined in accordance with e.g. the diameter of the transfer drum 2, is preferably as small as possible. The inclination angle θ formed by the tangent L with the side 6*c* extending from the flexing point 6*a* of the hill-shaped 6 to the tip 6*b* thereof is preferably within a range from 0° to 20° (inclusive). The reason is as follows. If this angle is smaller than 0°, the sheet 4 may not warp sufficiently within the hill-shaped guide 6. On the other hand, if the angle is larger than 20°, the sheet 4 sent out from the hill-shaped guide 6 pushes the outer surface of the transfer drum 2. As a result, the transfer nip 3 may be stretched out undesirably.

The angle ϕ of the flexing point 6*a* of the hill-shaped guide 6 is preferably within a range from 160° to 170°. If this angle is larger than 170°, the sheet 4 may not warp sufficiently within the hill-shaped guide 6. If the angle is smaller than 160°, the transportation path of the sheet 4 may fluctuate undesirably, thus impairing the transfer quality remarkably. The reason is as follows. Several kinds of sheets 4 having different thicknesses, rigidities and warping natures are supplied to the transfer device, and the transportation path of the sheet 4 defined by the hill-shaped path fluctuates in accordance with the status of the sheet 4. For example, assuming that a specific sheet 4 passes the path indicated by solid line 4 in FIG. 2 to be send out to the transfer nip 3, a specific sheet that is more easily warp than the sheet 4 passes a path with large curvature indicated by a phantom line 4'. Such fluctuation in the transportation path of the sheet gives rise to differences in the time when the tip of the sheet 4 reaches the transfer nip 3. This leads to deviations of the adsorption position from the normal position, and hence different amounts of blank in the tip of the sheet. This is because whereas the shifting speed of the sheet 4 is constant, the length of the transportation path differs in accordance with the curvature of the sheet. If the angle $\phi$ is smaller than 160°, the transportation path fluctuates greatly. In order to prevent the fluctuation in the transportation path, it is ideal to set the curvature of the sheet 4 for zero, i.e., to place the sheet 4 in a state where it does not warp. Actually, in order to stabilize the posture of the sheet 4 rushing into the transfer nip 3 regardless of the kind of the sheet 4, the warping of the sheet 4 is not inevitable. This has been already explained above.

A pushing plate 9 is arranged below the hill-shaped guide 6. The pushing plate 9 is a thin plate made of an elastic material, e.g., resin. The one end of the pushing plate 9 is secured to a supporting member 10. The other end thereof is pushed against the tip **6*b* of the hill-shaped guide 6 using the elastic force of the pushing plate 9 itself. Therefore, the sheet 4 guided along the hill-shaped guide 6, while being pushed against the tip 6*b* of the hill-shaped under the elastic force of the pushing plate 9, is sent out to the transfer nip 3. As a result, the sheet 4 warped within the hill-shaped guide 6 will not move downward from the tip 6*b* to push the outer surface of the transfer drum 2. It should be noted that the pushing force of the sheet 4 by the pushing plate 9 is set so that the tip 6*b* of the hill-shaped guide 6 exerts frictional resistance on the sheet 4. If the frictional resistance is large, the sheet 4 is jammed within the hill-shaped guide 6, and the sheet 4** may warp over an acceptable limit.

Figure 3:
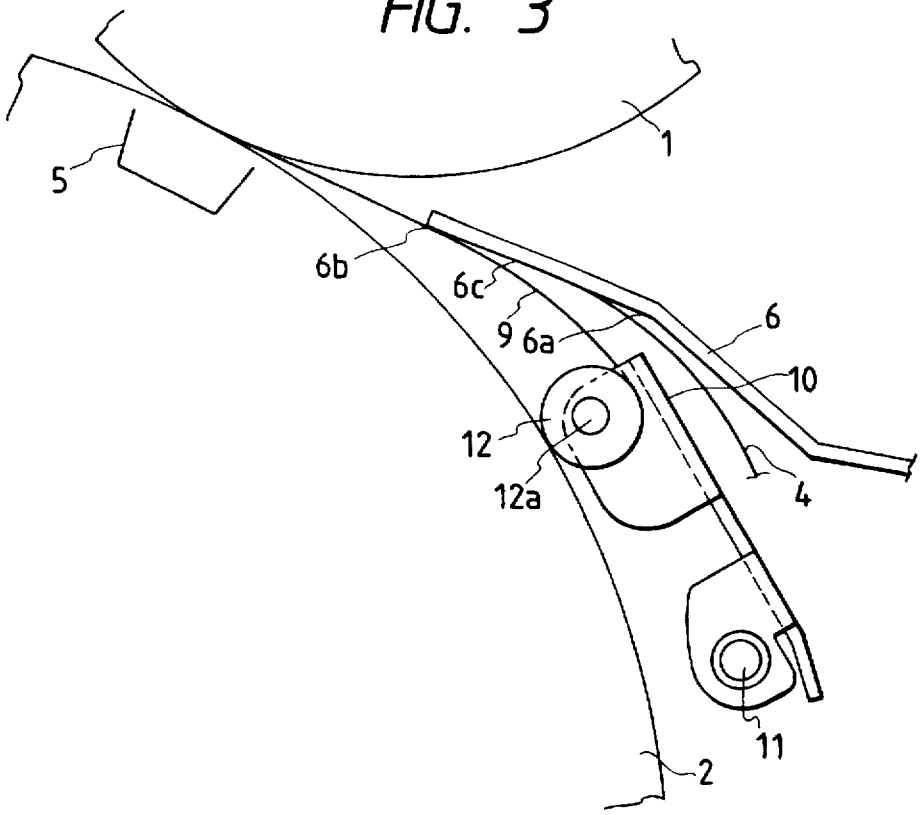
FIG. 3 is a view showing a structure of attaching a pushing plate to a hill-shaped guide shown in FIG. 2.

The supporting member 10 may be dedicated to support the pushing plate 9, but it may also have another function. One example thereof is shown in FIG. 3. In the example shown in FIG. 3, the supporting member is provided rotatably about a shaft 11. Both ends of the shaft 11 are supported by a supporting unit (not shown) of the transfer drum 2. To the supporting member 10, a tracking roller 12 is rotatably attached along a shaft **12*a*. Two tracking rollers 12 are provided, one for each of both ends in the axial direction of the transfer drum 2. In order to push the tracking rollers 12 against the outer surface of the transfer drum 2, the supporting member 10 is urged in a counterclockwise direction about the shaft 11 by an urging means (e.g. spring) not shown. The transfer drum 2 can be detached from the photosensitive drum 1 downward in the figure. When it is detached, the supporting member 10 rotates in a counterclockwise direction about the shaft 11. Thus, the pushing plate 9 leaves from the tip 6*a* of the hill-shaped guide 6. When the transfer drum 2 is mounted to abut on the photosensitive drum 1 substantially, the tracking roller 12 abuts on the transfer drum 2 so that the pushing plate 9 is brought into contact with the hill-shaped guide 6. In detachment of the transfer drum 2, since the pushing plate 9 leaves from the hill-shaped guide 6, even if a paper jam occurs within the hill-shaped guide 6, the sheet 4** can be easily pulled out.

Embodiment 2

Figure 4:
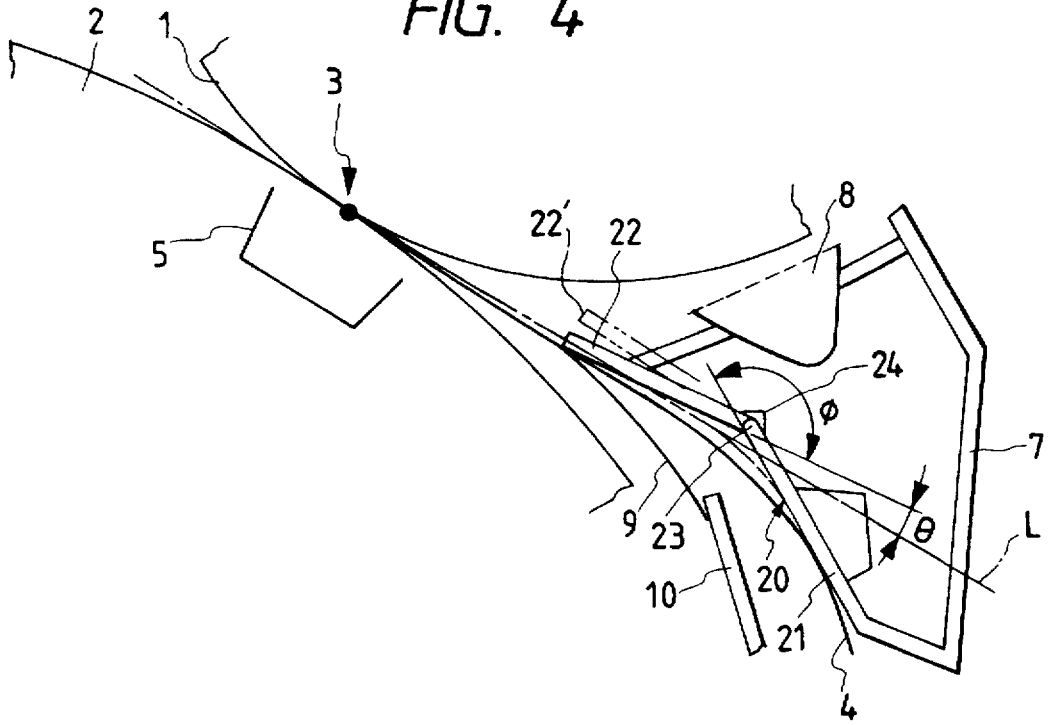
FIG. 4 is a view showing the main part of the transfer device according to the second embodiment of the present invention in a section in the same direction as FIG. 2.

FIG. 4 shows the second embodiment of the present invention. In FIG. 4, like reference numerals denote like parts in FIG. 2. In this embodiment, the hill-shaped guide 6 of FIG. 2 is modified. Namely, in this embodiment, a hill-shaped guide 20 is composed of a first plate-like guiding member 21 integral to the dust sucking duct 7 and a second plate-like guiding member 22 separated from the duct 7. The guiding member 21 and the guiding member 22 are coupled with each other so as to rotate about a shaft 23. An urging member 24 serves to urge the second guiding member 22 in a counterclockwise direction about the shaft 23 in the figure. The urging member 24 may be a twisting spring attached to the shaft 23. Incidentally, in order to prevent the second guiding member 22 from rotating beyond a necessary degree in the counterclockwise direction, a stopper is preferably arranged at a suitable position.

In the above configuration, while the sheet 4 supplied toward the hill-shaped guide 20 shifts from the first guiding member 21 to the second guiding member 22, a supporting reaction force by the sheet 4 is exerted on the second guiding member 22. Up to a position where the reaction force and the urging force by the urging member 24 are balanced, the second guiding member 22 rotates clockwise about the shaft 23. For this reason, when a standard sheet 4 is supplied, if the urging force by the urging member 24 is defined so that the inclination angle $\theta$ formed by the second guiding member 22 with the tangent L and the angle $\phi$ formed by both guiding members 21 and 22 are substantially equal to those in the first embodiment, the same functional effect as in the first embodiment can be obtained.

When a stiff sheet like a thick sheet of paper is supplied, as it travels forward, it is apt to warp greatly. For this reason, where the shape of the hill-shaped guide 20 remains unchanged, with an increase in the warp in the sheet 4, the sheet 4 will be sent out gradually downward from the hill-shaped guide 20. As a result, the transfer drum 2 is pushed by the sheet 4 to extend the transfer nip 3. In this embodiment, however, with an increase in the warp of the sheet 4, the second guiding member 22 moves toward the photosensitive drum 1 as indicated by a phantom line 22' so that the sending-out direction of the sheet 4 will not deviate from the transfer nip 3 toward the side of the transfer drum 2.

Figure 5:
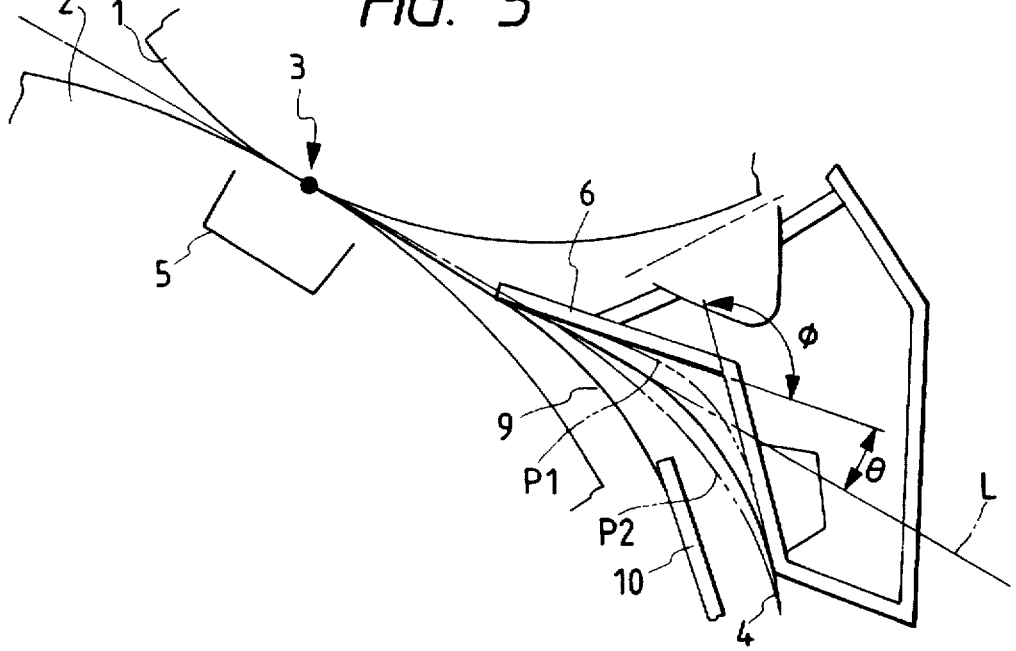
FIG. 5 is a view showing an example of the transfer device having the configuration shown in FIG. 2, in which the angle of the hill-shaped is defined unsuitably.
Figure 6:
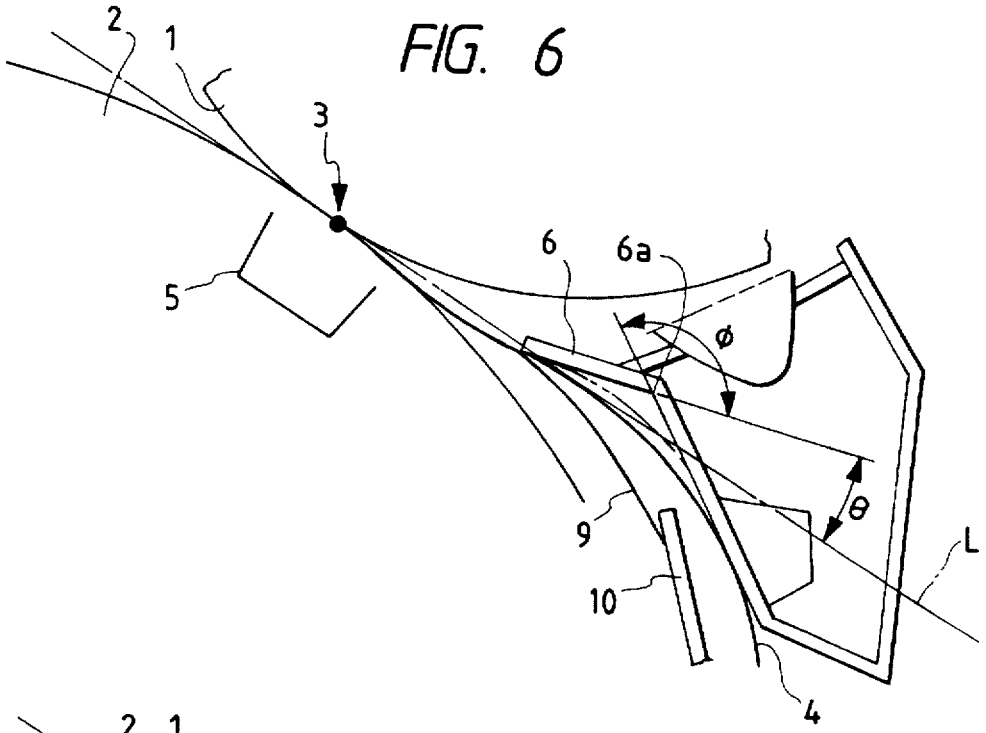
FIG. 6 is a view showing another example of the transfer device having the configuration shown in FIG. 2, in which the angle of the hill-shaped is defined unsuitably.
Figure 7:
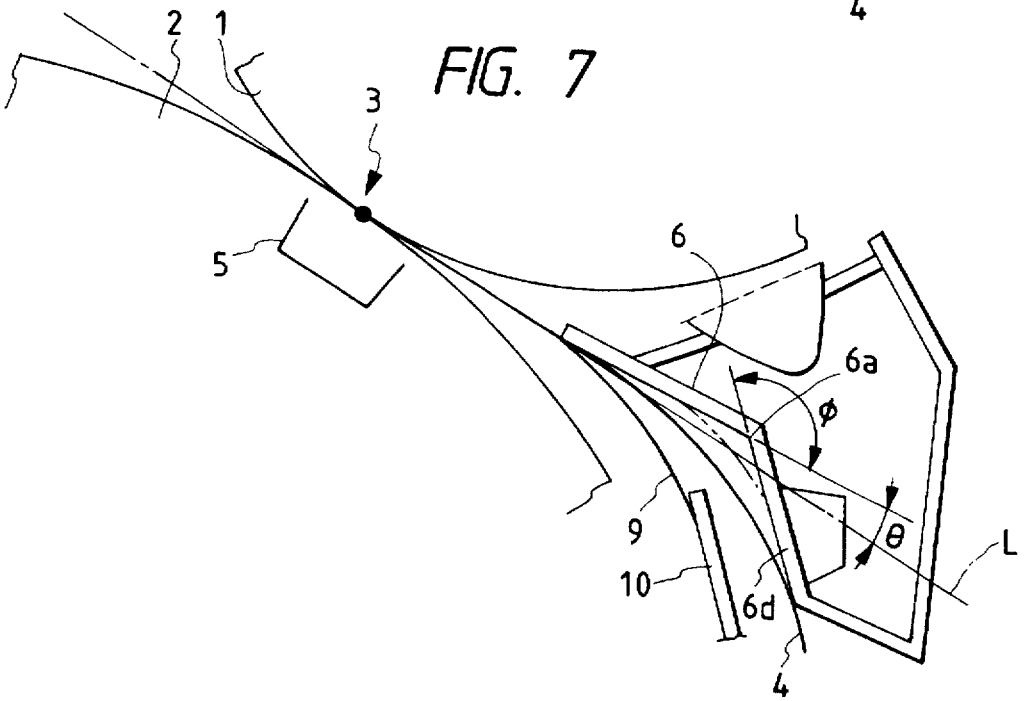
FIG. 7 is a view showing still another example of the transfer device having the configuration shown in FIG. 2, in which the angle of the hill-shaped is defined unsuitably.

FIGS. 5 to 7 show examples in which the angle 100 is larger than the optimum range and the angle $\phi$ is smaller than the optimum range in the transfer device having the same configuration as that of FIG. 2. In the configuration of FIG. 5, the angle $\theta$ is remarkably large and the angle $\phi$ is not large enough, and therefore the transportation path of the sheet 4 fluctuates greatly as indicated by phantom lines P1 and P2. In the configuration of FIG. 6, the angles 100 and $\theta$ are inappropriate and the flexing point **6*a* is also too near to the transfer nip 3 so that the outer surface of the transfer drum 2 is apparently held down by the sheet 4. In the configuration of FIG. 7, the angles $\theta$ and $\phi$ are inappropriate and the side 6*d* communicating the flexing point 6*a* of the hill-shaped guide 6 with the sheet supplying source is more greatly inclined toward the transfer drum 2 than in the configuration of FIG. 2. Therefore, the sheet 4** warps greatly and the transportation path also changes greatly.

The embodiments have been given of a color multiple-transfer device. The present invention, however, is applicable to several kinds of transfer devices in which a sheet of paper is to be adsorbed on the transfer drum. In the above embodiments, the angles of the hill-shaped guide 6 or 20 are mainly adjusted to stabilize the posture of the sheet 4 so that the adsorption of the sheet 4 and the transfer of the toner images can be made by the single charging corotron 5. But, instead of or in addition to such a configuration, the following means may be adopted. When the sheet has been once adsorbed on the transfer drum, the transfer nip will not be extended disadvantageously. Therefore, the first cycle of the transfer drum may be used as an adsorption dummy cycle while the adsorption of the toner image and the adsorption of the sheet and the transfer of the toner image is started from the next cycle. Adoption of such an adsorption dummy cycle increases the number of rotations of the transfer drum so that the time necessary for the transfer may be prolonged. In order to obviate such an inconvenience, it is preferable to decide whether the adsorption dummy cycle should be performed in accordance with the switching state of a switch. Although the switch may be switched manually by an operator, it may be automatically switched in accordance with the use of the transfer device. For example, in a monochromatic printing mode or printer mode, the adsorption dummy cycle is performed automatically.

As described above, in accordance with the present invention, since a sheet can be caused to rush onto the transfer position of the drum in its optimum posture while being appropriately warped by the hill-shaped guide having a suitable angle, where sheet adsorption and image transfer are to be performed by a single charger, fluctuation in the adsorption status of the sheet can be suppressed, thus performing the image transfer with high quality. In accordance with one embodiment of the invention, the rushing posture of the sheet onto the transfer position can be further stabilized to perform the image transfer with higher quality. In accordance with another embodiment of the invention even if the sheet used is stiff like a thick sheet, the rushing posture of the sheet onto the transfer position can be stabilized.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A transfer device comprising:

a photosensitive drum having an outer surface on which an image to be transferred is formed;

a transfer drum having an outer surface and arranged in parallel to said photosensitive drum and substantially in contact with said outer surface of said photosensitive drum at a transfer position, said transfer drum capable of adsorbing a sheet on its outer surface; and sheet guiding means for guiding said sheet supplied toward said transfer drum to the transfer position between said photosensitive drum and said transfer drum, the sheet guiding means having a first end and a second end, the first end being closer to the transfer position than the second end, wherein at the first end of said sheet guiding means a hill-shaped guide is provided which flexes at a flexing point in a plane orthogonal to the rotary axis of each of both drums so as to be convex toward said photosensitive drum, and wherein a portion of said sheet guiding means extending from the first end to said flexing point forms an inclination angle with respect to a tangent of said photosensitive drum passing through the transfer position, the inclination angle being equal to or greater than 0° measured from the tangent toward said photosensitive drum.

2. A transfer device according to claim 1, wherein the first end of said hill-shaped guide is inclined within a range from 0° to 20° with respect to the tangent of said photosensitive drum passing the transfer position.

3. A transfer device according to claim 1, wherein the inclination of the first end of said hill-shaped guide with respect to said tangent varies in accordance with a supporting reaction force of the sheet exerted on said hill-shaped guide.

4. A transfer device comprising:

a photosensitive drum having an outer surface on which an image to be transferred is formed;

a transfer drum having an outer surface and arranged in parallel to said photosensitive drum and substantially in contact with said outer surface of said photosensitive drum, said transfer drum capable of adsorbing a sheet on its outer surface; and sheet guiding means for guiding said sheet supplied toward said transfer drum to a transfer position between said photosensitive drum and said transfer drum, the sheet guiding means having a first end and a second end, the first end being closer to the transfer position than the second end, wherein at the first end of said sheet guiding means a hill-shaped guide is provided which flexes at a flexing point in a plane orthogonal to the rotary axis of each of both drums so as to be convex toward said photosensitive drum, an angle intervening said flexing point of said hill-shaped guide being within a range from 160° to 170°, and wherein the first end of said hill-shaped guide is inclined toward said photosensitive drum with respect to a tangent of said photosensitive drum passing the transfer position.

5. A transfer device comprising:

a photosensitive drum having an outer surface on which an image to be transferred is formed, a transfer drum having an outer surface and arranged in parallel to said photosensitive drum and substantially in contact with said outer surface of said photosensitive drum, said transfer drum capable of adsorbing a sheet on its outer surface;

sheet guiding means for guiding said sheet supplied toward said transfer drum to a transfer position between said photosensitive drum and said transfer drum, the sheet guiding means having a first end and a second end, the first end being closer to the transfer position than the second end; and a pushing plate arranged between said transfer drum and said sheet guiding means, said pushing plate being made of an elastic material and having a first end, wherein the first end of said pushing plate is pressed against the first end of said sheet guiding means by a force created by an elastic deformation of said pushing plate, wherein at the first end of said sheet guiding means a hill-shaped guide is provided which flexes at a flexing point in a plane orthogonal to the rotary axis of each of both drums so as to be convex toward said photosensitive drum, and wherein the first end of said hill-shaped guide is inclined toward said photosensitive drum with respect to a tangent of said photosensitive drum passing the transfer position.

* * * * *